United States Patent [19]

Klechka et al.

[11] 4,158,541

[45] Jun. 19, 1979

[54] APPARATUS FOR CALCINING GREEN COKE

[75] Inventors: Ernest W. Klechka, Strongsville; James R. Hemsath, Fairview Park, both of Ohio

[73] Assignee: The Standard Oil Company, Cleveland, Ohio

[21] Appl. No.: 797,086

[22] Filed: May 16, 1977

[51] Int. Cl.[2] ..... F27B 7/38

[52] U.S. Cl. ..... 432/116; 432/235; 193/2 R; 248/58; 414/160

[58] Field of Search ..... 432/103, 104, 105, 109, 432/111, 114, 115, 116, 106, 235, 239, 245; 110/14; 214/35 R; 193/2 R, 25 R; 248/58–60, 62; 431/343

[56] References Cited

U.S. PATENT DOCUMENTS

| | | | |
|---|---|---|---|
| 1,350,750 | 8/1920 | Truesdall et al. | 432/109 |
| 2,291,148 | 7/1942 | Carson | 248/58 |
| 2,941,791 | 6/1960 | Wienert | 432/109 |
| 3,061,300 | 10/1962 | Schultz | 110/182.5 |
| 3,170,786 | 2/1965 | Moklebust | 432/109 |
| 3,185,464 | 5/1965 | Meyer et al. | 432/105 |
| 4,043,746 | 8/1977 | Ritzmann | 432/106 |

*Primary Examiner*—Henry C. Yuen

*Attorney, Agent, or Firm*—Herbert D. Knudsen; William D. Mooney

[57] ABSTRACT

A hollow, high-temperature alloy pipe with motive means to move air there through is employed as a support structure for supporting the feed pipe in a conventional coke-calcining apparatus. The support pipe is horseshoe shaped, and the feed pipe is received in the seat of the horseshoe.

6 Claims, 3 Drawing Figures

APPARATUS FOR CALCINING GREEN COKE

BACKGROUND OF THE INVENTION

The present invention relates to an appartus for calcining green coke to produce calcined coke. More particularly, the present invention relates to an improved feeding system for feeding green coke into a coke calcining apparatus.

Processes for calcining green coke to produce calcined coke are well-known. Green coke is a carbonaceous material containing various solid hydrocarbons and is derived from various petroleum hydrocarbon fractions. As is, green coke has essentially no use. However, when green coke is heated at an elevated temperature for a sufficient period of time, the various solid hydrocarbons are either driven off or decomposed to yield a solid material comprising essentially carbon. This material, referred to as calcined coke, finds wide use in the manufacture of various types of electrodes such as those used in carbon arc steel and aluminum-making furnaces.

Green coke is conventionally calcined in an apparatus which includes a calcining kiln where the heating operation occurs. The calcining kiln normally takes the form of an elongated rotating cylinder which is tilted slightly so that green coke introduced in the upper end will slowly move through the kiln to the lower end as the kiln rotates. Natural gas is introduced into the lower end of the kiln where it is burned to provide the heat for effecting the calcination reaction. Calcined coke passes out of the lower end of the rotating kiln while gaseous byproducts pass out of the upper end of the kiln.

Since the gaseous byproducts passing out of a coke-calcining kiln contain entrained particulate matter, the gases are usually passed through a dust-settling chamber where the dust and other particles settle out. Then, the gases pass to the bottom of an off-gas stack where they are admixed with air, ignited and discharged to the atmosphere. In order to control the flow of off-gas from the kiln to the off-gas stack, a damper is provided between the dust settling chamber and the stack.

Conventionally, green coke is feed to the calcining kiln by means of a feed pipe having its outlet end within the upper end of the rotating cylinder defining the calcining kiln. At least a portion of the body of the feed pipe passes through the dust settling chamber, and the inlet end of the feed pipe is normally located above the dust settling chamber for receiving fresh green coke as well as dust which is recycled from the bottom of the dust-settling chamber. In order to maintain the feed pipe in proper position in the dust settling chamber, metal rods or cables attached to the superstructure of the dust settling chamber are employed to support the feed pipe. Normally, the temperatures of the gases generated in the kiln of such an apparatus are about 1300° F.

In a recent modification of the foregoing system, it has been proposed to introduce extra air into the kiln and conduct inceration of the off-gases in the kiln itself rather than in the base of the off-gas stack as is conventional. To this end, suitable air-supply means are added to the kiln for supplying the necessary air. With this design, it has been found that all of the heat necessary to conduct the calcination reaction can be derived from the combustion of the off-gases, thereby totally eliminating the need to supply natural gas or other combustion fuel to the kiln, except for start-up operation. However, it has also been found that when incineration of the off-gases occurs in the kiln itself, the reaction temperature in the kiln is raised to 2000° to 2500° F. Unfortunately, most commercially available metal alloys cannot withstand such high temperatures indefinitely especially when subjected to significant tensile stress. Accordingly, it has been found in practice that conventional feed pipes and the support systems therefor bend, warp and generally become non-servicable at these high temperatures.

Accordingly, it is an object of the present invention to provide an improved feeding system, and especially an improved support system for supporting the feed pipe, for use in a coke calcining apparatus which can withstand the high temperatures involved when the off-gas is incinerated in the kiln itself.

In addition, it is a further object of the present invention to provide an improved feeding system of the type described above which is simple in design, inexpensive to construct and simple to operate.

SUMMARY OF THE INVENTION

These and other objects are accomplished by the present invention in accordance with which a coke-calcining apparatus is provided with a feeding system comprising a feed pipe at least partially passing through the dust settling chamber of the apparatus, the feeding pipe being supported by a novel support system which in turn is mounted on the superstructure of the coke-calcining apparatus. The support structure is formed from a high-temperature alloy pipe preferably arranged in a horseshoe shape with the feed pipe received in the seat of the horseshoe. Air or other gas is made to flow through the bore of the pipe, preferably by convection, to provide cooling of the support means. With this means, the support system of the feed pipe is maintained below its deformation temperature, and hence the feed pipe remains in place even though extremely hot temperatures are encountered.

Thus, the present invention provides an improved apparatus for calcining green coke to produce calcined coke, the apparatus comprising a kiln for heating green coke and incinerating the off-gas produced by the heating operations, dust removal means for removing particulate matter from incinerated off-gas produced in the kiln, a feed pipe passing through at least a portion of the body of the dust settling chamber for feeding green coke into one end of the kiln, and support means for supporting the feed pipe in the dust settling chamber, the improvement in accordance with the present invention wherein the support means comprises a hollow pipe and motive means for moving a gas through the bore of the pipe.

BRIEF DESCRIPTION OF THE DRAWINGS

The present invention may be more easily understood by reference to the following drawings wherein.

DETAILED DESCRIPTION

Figure 1:
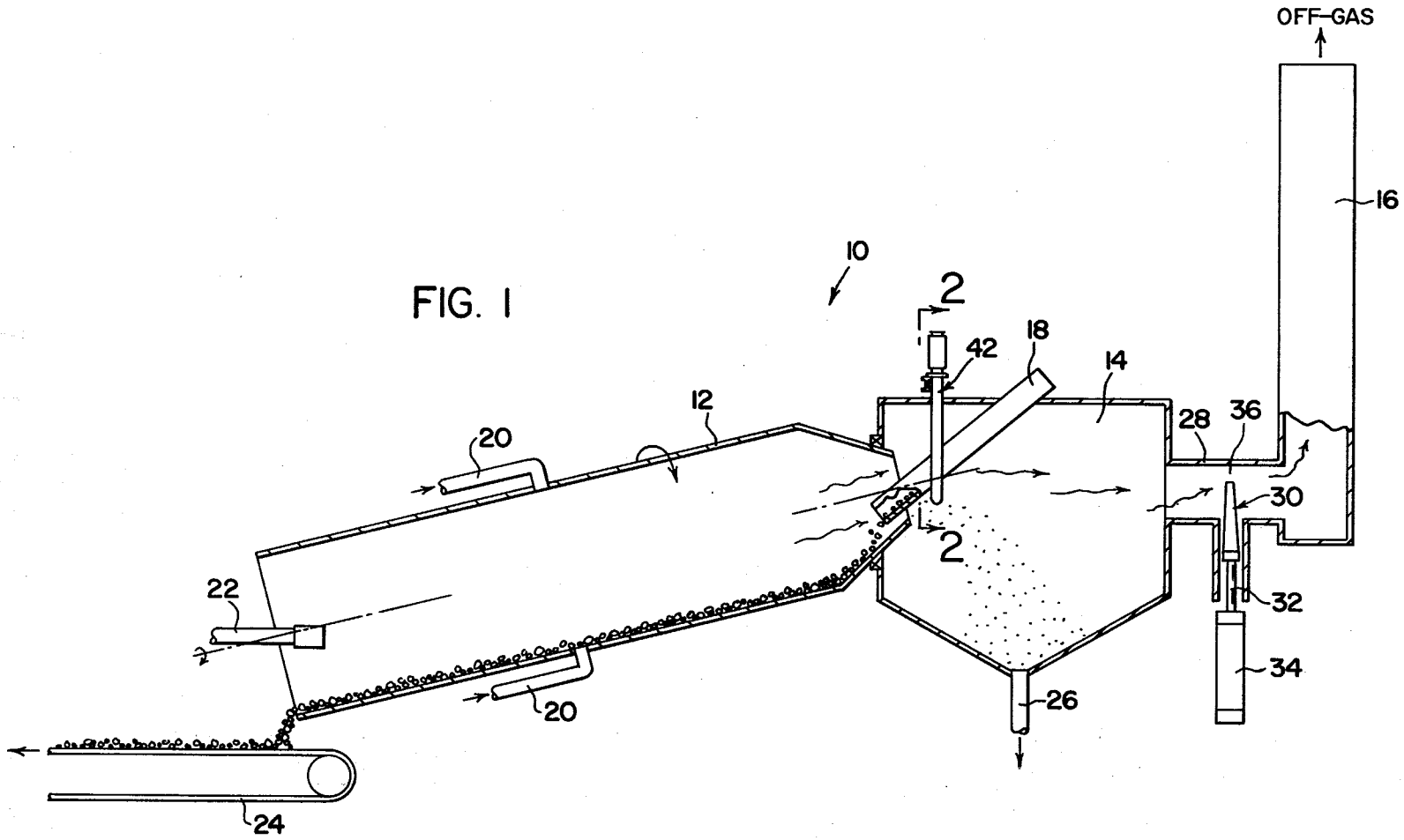
FIG. 1 is a schematic view illustrating an apparatus for calcining green coke including the inventive feeding means.

Apparatus for calcining green coke, generally shown at 10 in FIG. 1, takes the form of a coke calcining kiln 12, a dust settling chamber 14 and an off-gas stack 16.

Kiln 12 is rotably mounted on suitable support means (not shown) so that it is slightly tilted with respect to the horizontal as illustrated in the figure. Feed pipe 18 is provided for feeding green coke into the upper end of kiln 12. Oxygen supply means 20 are provided for feeding oxygen to the interior of kiln 12 while gas supply means 22 is provided for supplying natural gas to the interior of kiln 12 as it rotates. Because kiln 12 is tilted slightly with respect to horizontal, green coke introduced into the upper end of kiln 12 via feed pipe 18 will slowly travel from the upper end of kiln 12 to the lower end of kiln 12 as kiln 12 rotates. Coke passing out of the lower end of kiln 12 is deposited on a suitable conveying means such as conveyor 24 which conveys the coke, now completely calcined, to suitable transportation means.

As shown in FIG. 1, the upper end of kiln 12 is received in one side of dust settling chamber 14. Since the off-gases produced during calcination of green coke in kiln 12 contains a significant amount of particulate matter, dust settling chamber 14 is provided so that this particulate matter is separated out from the off-gases prior to discharge of the off-gases through off-gas stack 16. Particulate matter settling out of the off-gases in dust settling chamber 14 is collected at the bottom and recycled via suitable recycle means 26 to feed pipe 18.

Off-gases which have been substantially purified of their particulate matter content are passed from dust settling chamber 14 to off-gas stack 16 via conduit 28. In conduit 28 is located damper 30 which together with conduit 28 define a flow opening or passageway for the off-gas. In order to control the size of flow opening or passageway 36 and hence the flow of off-gases therethrough, damper 30 is mounted on suitable control rods 32 which in turn are received in elevating means 34 which raises and lowers damper 30 via control rods 32 to any desired position. Motive means such as elevating means 34 is provided with a suitable control systems (not shown) so that the position of damper 30 can be manually or automatically adjusted, as desired.

Figure 2:
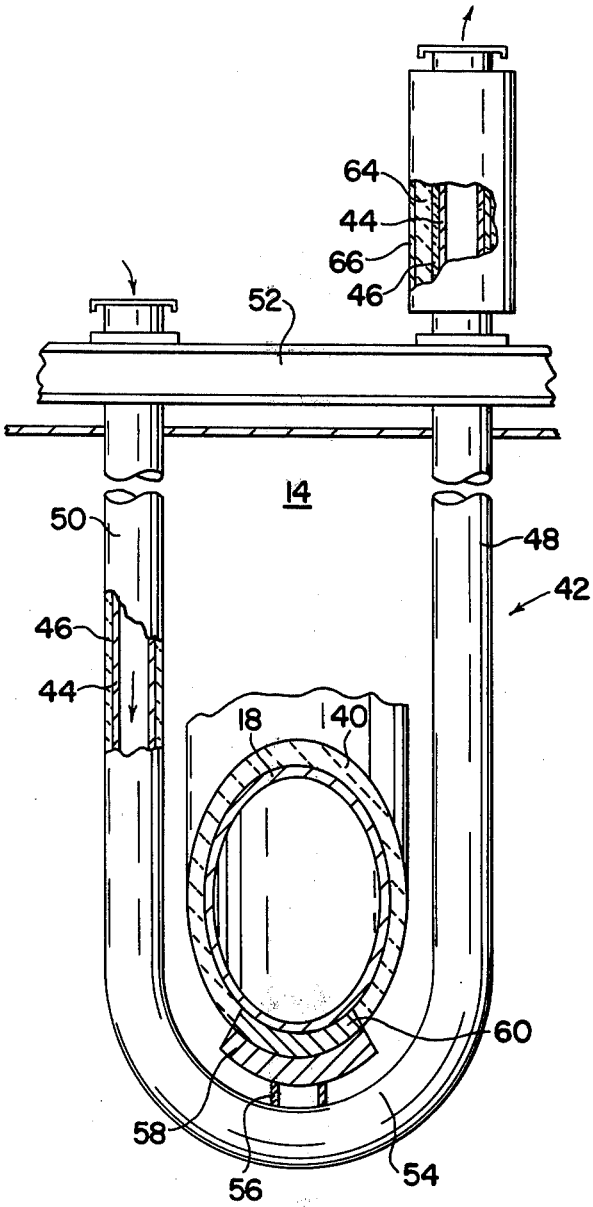
FIG. 2 is a front view of the feeding system illustrated in FIG. 1 taken along line 2—2 of FIG. 1.
Figure 3:
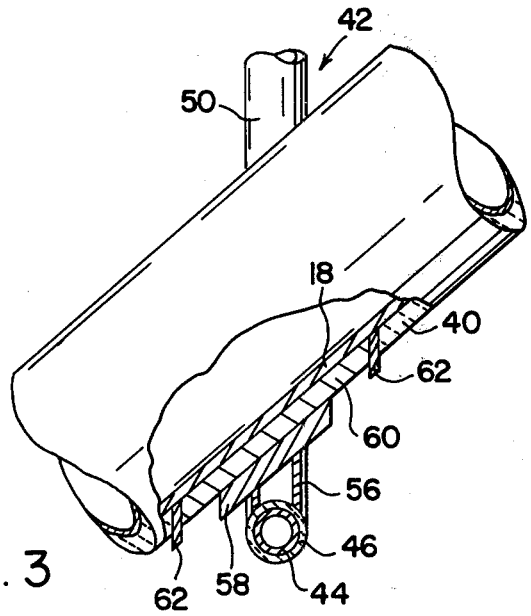
FIG. 3 is a side view, partially in cross section, of the feeding system of FIG. 2.

Referring to FIGS. 2 and 3, the details of the inductive feeding system including feed pipe 18 will be described. Feed pipe 18 is formed from a high temperature alloy, for example HP40 (35% Ni 25% Cr steel alloy). On the outer surfaces of feed pipe 18 is thermal insulating layer 40 formed from a ceramic refractory such as Harbison-Walker's HW castable 28. In order to securely anchor the ceramic refractory to metal feed pipe 18 310 hexmesh, which is a hexagonally-shaped metal mesh network, is welded onto feed pipe 18 and the HW Castable 28 deposited over the 310 hexmesh. With this design, feed pipe 18 has a deformation temperature of about 2500° F. and can therefore withstand the high temperatures generated in kiln 12 when the off-gases are incinerated therein.

Feed pipe 18 and associated thermal insulating layer 40 are supported by support system 42. Support System 42 takes the form of hollow high temperature alloy pipe 44 which is bent in a horseshoe shape as illustrated in FIG. 2. A thermal insulating layer 46 is provided on the surfaces of pipe 44 to improve its temperature resistance. In the specific embodiment illustrated, thermal insulating layer 46 is formed from kaowool, which is blown ceramic fiber made from kaolin clay, the kaowool being cemented to pipe 44 and anchored to pipe 44 with kaowool anchors.

As illustrated in FIGS. 2 and 3, legs 48 and 50 of pipe 44 are vertically arranged and supported in the superstructure of dust settling 14, the superstructure generally taking the form of I-beam 52. In this configuration, pipe 44 defines an upwardly facing seat 54 in which is received feed pipe 18. In order to support feed pipe 18 in seat 54, bearing shoe 58 mounted to seat 54 via spacer 56 is provided. Bearing shoe 58 bears against bearing plate 60 mounted on feed pipe 18 for supporting the weight of feed pipe 18 and thermal insulating layer 40. With this structure, feed pipe 18 can move relative to support system 42 to accommodate changes in size of feed pipe 18 due to changes in temperature. Safety stops 62 are provided at the front and rear ends of bearing plate 60 to prevent excessive movement of feed pipe 18.

As illustrated in FIG. 2, upwardly extending leg 48 of horseshoe-shaped pipe 44 is longer than the other leg 50, about 6 feet longer in the specific embodiment shown. The upper end of leg 48 is wrapped with a layer 64 of thermal insulation such as mineral wool, which in turn is provided with a layer of stainless steel sheathing 66 for protection. The additional layer of thermal insulation 64 keeps the temperature of the upper end of leg 48 hotter than the upper end of leg 50 and by this means creates a natural draft of air through the interior of pipe 44. This nautral air draft provides cooling to U-shaped pipe 44 so that its temperature will remain below the deformation value.

In operation, the coke calcining apparatus of FIG. 1 is used in essentially the same way as convential calcining systems of similar designs. In particular, green coke is introduced into the upper portion of kiln 12 via feed pipe 18 and kiln 12 is rotated so that green coke slowly travels from the upper portion of kiln 12 to the lower portion thereof. Natural gas if necessary is introduced into kiln 12 via gas supply conduit 22 for heating the green coke to the elevated temperature necessary for calcination. Air is introduced into kiln 12 via air supply conduit 20 which cause the off-gases produced by heating the green coke in kiln 12 to ignite. Once steady state is reached, the gas supply from gas conduit 22 can be significantly reduced or even completely shut off. Off-gases produced by calcination and ignitation pass out of the upper portion of kiln 12 and into udst settling chamber 14 where particulate matter is removed therefrom. The cleaned off-gases pass through passageway 28 and into off-gas stack 16 where they are discharged. The flow of off-gases through passageway 36 is controlled by damper 30.

In accordance with the present invention, support system 42 for supporting feed pipe 18 is formed from a hollow pipe, preferably carrying a layer of thermal insulation on its external surfaces. In addition, means are provided for creating a flow of air or other gas through the interior of the pipe. When the off-gases produced in kiln 12 are incinerated in the kiln rather than in the base of off-gas stack 16, the temperatures of the off-gas is passing through dust settling chamber 14 reach 2500° F. This temperature is so high that support systems of conventional design are quickly rendered unservicable. In accordance with the present invention, however, support system 42 can withstand these high temperatures for extended periods of time because it is formed from a hollow pipe and may therefore be cooled by air or other gas following through its interior. Provision of an external covering of a thermal insulation further improves the cooling effect provided by the air or other gas passing through the pipe interior. Moreover, use of a passive air-motivating means such as that illustrated in the specific embodiment is simple to use and inexpensive to construct.

Although, only a single embodiment of the present invention has been described above, it should be appreciated that many modifications can be made without departing from spirit and scope of the invention. For example, it should be appreciated that active motive means such as a fan or the like can be employed to move air through the interior of U-shaped pipe 44. However, the passive means illustrated in the specific embodiment is preferred since it is less expensive. Also, it should be appreciated that materials other than those sepcifically described can be employed to form the thermal insulating layers and the high temperature alloy pipes. All such embodiments and modifications are intended to be included within the scope of the present invention, which is to be limited only by the following claims.

We claim:

1. In an apparatus for calcining green coke to produce calcined coke, said apparatus comprising a kiln for heating said green coke and incinerating the off-gas produced by said heating, dust removal means for removing particulate matter from incinerated off-gas produced in said kiln, a feed pipe passing through at least a portion of the body of said dust settling chamber for feeding green coke into one end of said kiln, and support means for supporting said feed pipe in said dust settling chamber, the improvement wherein said support means comprises a hollow pipe and motive means for moving a gas through the bore of said pipe.

2. The apparatus of claim 1 wherein said gas is air.

3. The apparatus of claim 2 wherein said motive means is passive.

4. The apparatus of claim 3 wherein said pipe is shaped in the form of a U and wherein the legs of said U-shaped pipe are arranged essentially vertically upward.

5. The apparatus of claim 4 wherein said motive means comprises a layer of thermal insulation around only one of said legs.

6. The apparatus of claim 5 further comprising a layer of thermal insulation covering the exterior of said U-shaped pipe and further comprising a layer of thermal insulation covering the exterior of said feed pipe.

* * * * *